US008383972B2

(12) United States Patent
Liu

(10) Patent No.: US 8,383,972 B2
(45) **Date of Patent: *Feb. 26, 2013**

(54) ILLUMINATED KEYBOARD

(75) Inventor: Yung-Lung Liu, Taichung Hsien (TW)

(73) Assignee: Sunrex Technology Corp., Taichung (TW)

( * ) Notice: Subject to any disclaimer, the term of this patent is extended or adjusted under 35 U.S.C. 154(b) by 322 days.

This patent is subject to a terminal disclaimer.

(21) Appl. No.: 12/873,341

(22) Filed: Sep. 1, 2010

(65) Prior Publication Data

US 2012/0048702 A1 Mar. 1, 2012

(51) Int. Cl.
*H01H 9/00* (2006.01)

(52) U.S. Cl. ..... 200/310

(58) Field of Classification Search ..... 200/5 A, 200/310, 314

See application file for complete search history.

(56) References Cited

U.S. PATENT DOCUMENTS

2012/0048700 A1* 3/2012 Liu ..... 200/5 A
2012/0048701 A1* 3/2012 Liu ..... 200/5 A
2012/0097511 A1* 4/2012 Liu ..... 200/5 A
2012/0098751 A1* 4/2012 Liu ..... 345/170

* cited by examiner

*Primary Examiner* — Vanessa Girardi

(57) ABSTRACT

An illuminated keyboard includes keys; a spacer board on a base plate and comprising units each including two first groove connectors and two second groove connectors; an optically transmissive film circuit board on the spacer board and comprising a second circuitry, switch contacts, and first holes each with the first or second groove connector passing; a rubber plate of optically transmissive plastic and on the film circuit board, the rubber plate comprising resilient domes having a recessed top for retaining the key, a conductive bottom stem above the switch contact, and second holes grouped as groups each formed as four corners around the dome, the first or second groove connectors adapted to pass through the second holes; and an LED circuit board on the rubber plate and comprising a first circuitry and LEDs electrically connected to the first circuitry to be powered therefrom.

15 Claims, 7 Drawing Sheets

ILLUMINATED KEYBOARD

BACKGROUND OF THE INVENTION

1. Field of Invention

The invention relates to keyboards and more particularly to an illuminated keyboard with improved characteristics.

2. Description of Related Art

Laptops are widely used throughout the world. Typically, a laptop is equipped with a scissor-switch keyboard. In detail, a plurality of scissor switches each is mounted between a key and a base plate. Scissor-switch keyboards have the advantages including lightweight, low-profile, and easy operation. However, a user can only operate a laptop in an illuminated environment since back light arrangement is not provided by the laptop. Thus, sometimes their uses are not convenient.

A typical illuminated keyboard is characterized in that LEDs (light-emitting diodes) are attached to the bottom of a PCB (printed circuit board). LEDs may emit light upward to illuminate the PCB and components thereon. However, no light guide means for directing a uniform illumination to the keys is provided. Thus, some keys proximate to the LEDs are sufficiently lit and other keys distal the LEDs are dim. This can cause inconvenience in use.

Another typical illuminated keyboard is characterized in that a membrane circuit board is provided on an aluminum plate. Under the aluminum plate there is a backlight layer. LEDs are provided on the backlight layer. Light emitted by the LEDs is directed upward through holes of the aluminum plate and the circuit board onto the bottoms of keys. It is advantageous for being capable of effecting a uniform illumination to all keys. However, the combination of the circuit board, the aluminum plate, and the backlight layer can greatly increase thickness of the keyboard. This can compromise the low-profile feature of laptops. Thus, the need for improvement still exists.

SUMMARY OF THE INVENTION

It is therefore one object of the invention to provide an illuminated keyboard comprising a plurality of keys arranged in a predetermined layout; a base plate; a spacer board disposed on the base plate, the spacer board comprising a plurality of units each corresponding to the key thereabove, each unit including two first groove connectors and two second groove connectors; an optically transmissive film circuit board for generating signals in response to a pressing of the key, the film circuit board disposed on the spacer board and comprising a second circuitry, a plurality of switch contacts, and a plurality of first holes each being in a one to one relationship to the first or second groove connector so that the first or second groove connector is adapted to pass through the first hole; a rubber plate formed of optically transmissive plastic and disposed on the film circuit board, the rubber plate comprising a plurality of resilient domes each disposed under the key, the dome having a recessed top for retaining the key, a conductive bottom stem disposed above the switch contact, and a plurality of second holes grouped as a plurality of groups, each group formed as four corners around the dome, the second holes being aligned with the first holes and the first groove connectors or the second groove connectors so that the first or second groove connectors are adapted to further pass through the second holes; and an LED circuit board disposed on the rubber plate and comprising a first circuitry and a plurality of LEDs electrically connected to the first circuitry to be powered therefrom, wherein the keys are disposed on the LED circuit board.

It is another object of the invention to provide an illuminated keyboard comprising a plurality of keys arranged in a predetermined layout; a base plate; a spacer board disposed on the base plate, the spacer board comprising a plurality of units each corresponding to the key thereabove, each unit including two first groove connectors and two second groove connectors; an optically transmissive film circuit board for generating signals in response to a pressing of the key, the film circuit board disposed on the spacer board and comprising a second circuitry, a plurality of switch contacts, and a plurality of first holes each being in a one to one relationship to the first or second groove connector so that the first or second groove connector is adapted to pass through the first hole; an LED circuit board disposed on the film circuit board and comprising a first circuitry and a plurality of LEDs electrically connected to the first circuitry to be powered therefrom; and a rubber plate formed of optically transmissive plastic and disposed on the LED circuit board, the rubber plate comprising a plurality of resilient domes each disposed under the key, the dome having a recessed top for retaining the key, a conductive bottom stem disposed above the switch contact, a plurality of second holes each adjacent to the dome, and a plurality of third holes grouped as a plurality of groups, each group formed as four corners around the dome, the third holes being aligned with the first holes and the first groove connectors or the second groove connectors so that the first or second groove connectors are adapted to further pass through the third holes, wherein the keys are disposed on the rubber plate and the LED is disposed in the second hole.

It is a further object of the invention to provide an illuminated keyboard comprising a plurality of keys arranged in a predetermined layout; a base plate; a spacer board disposed on the base plate, the spacer board comprising a plurality of units each corresponding to the key thereabove, each unit including two first groove connectors and two second groove connectors; an LED circuit board disposed on the film circuit board and comprising a first circuitry and a plurality of LEDs electrically connected to the first circuitry to be powered therefrom; an optically transmissive film circuit board for generating signals in response to a pressing of the key, the film circuit board disposed on the spacer board and comprising a second circuitry, a plurality of switch contacts, a plurality of first holes each adjacent to the switch contact, and a plurality of second holes each being in a one to one relationship to the first or second groove connector so that the first or second groove connector is adapted to pass through the second hole; and a rubber plate formed of optically transmissive plastic and disposed on the LED circuit board, the rubber plate comprising a plurality of resilient domes each disposed under the key, the dome having a recessed top for retaining the key, a conductive bottom stem disposed above the switch contact, a plurality of third holes each adjacent to the dome, and a plurality of fourth holes grouped as a plurality of groups, each group formed as four corners around the dome, the fourth holes being aligned with the second holes and the first groove connectors or the second groove connectors so that the first or second groove connectors are adapted to further pass through the fourth holes, wherein the keys are disposed on the rubber plate and the LED is disposed in the first and third holes.

The above and other objects, features and advantages of the invention will become apparent from the following detailed description taken with the accompanying drawings.

DETAILED DESCRIPTION OF THE INVENTION

Figure 1:
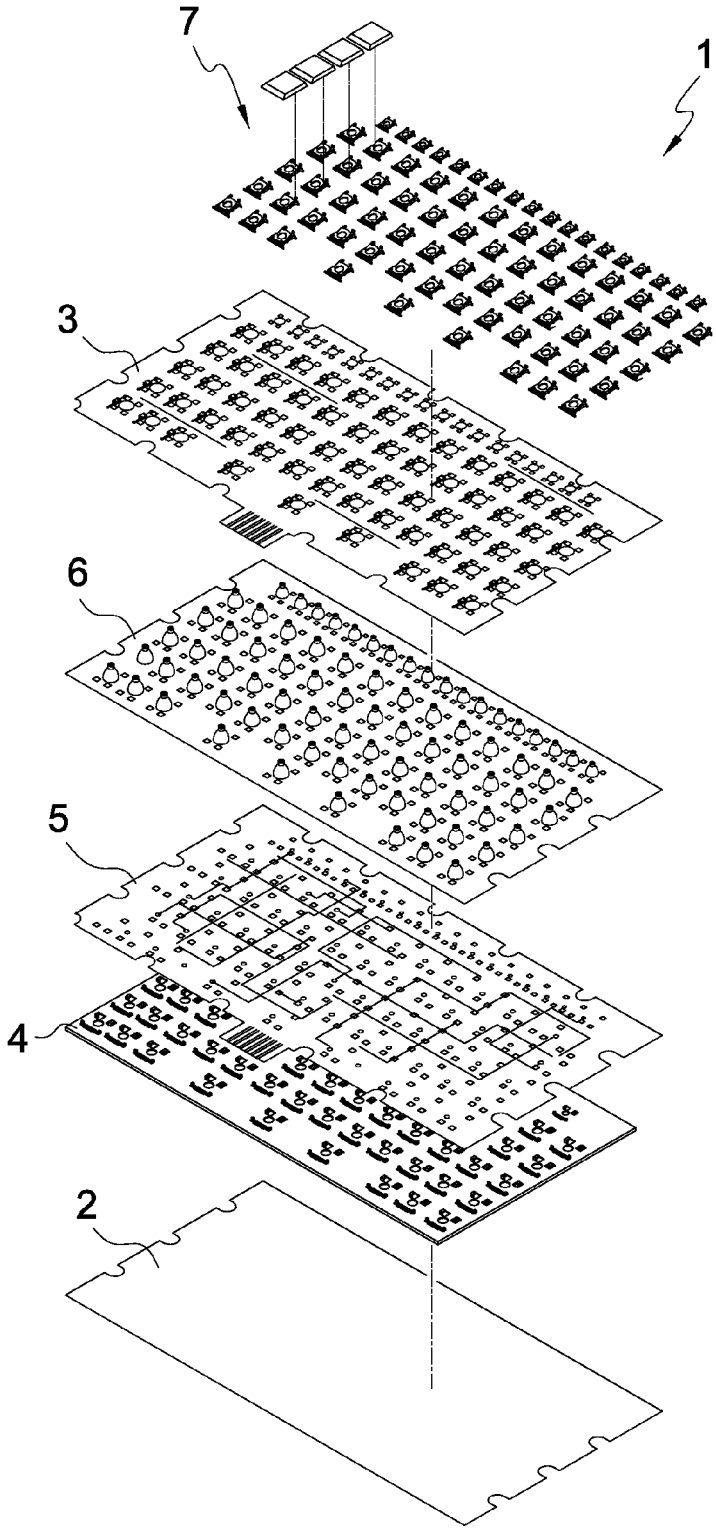
FIG. 1 is an exploded view of an illuminated keyboard according to a first preferred embodiment of the invention.
Figure 2:
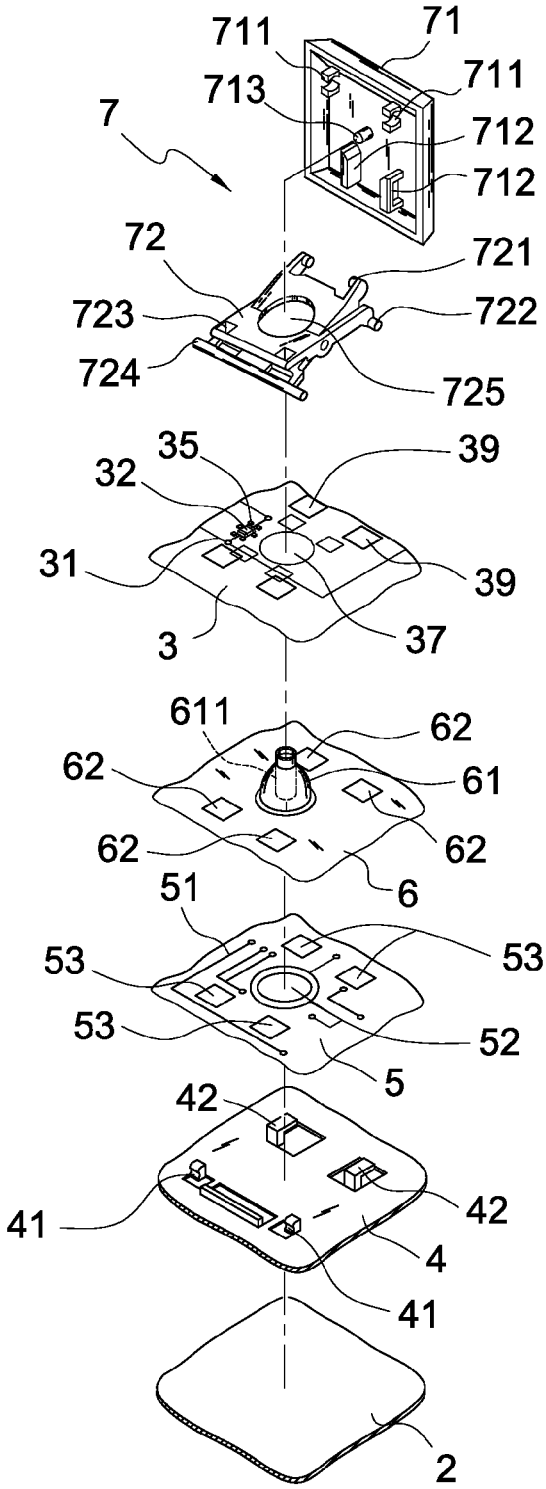
FIG. 2 is a fragmentary view of FIG. 1 showing a single key and associated components therebelow to be assembled.
Figure 3:
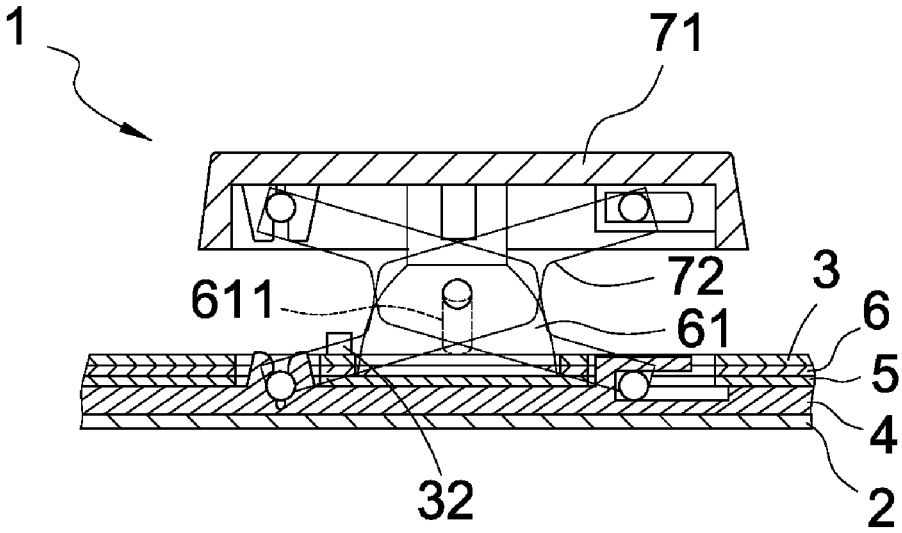
FIG. 3 is a longitudinal sectional view of the assembled key and its components in FIG. 2.

Referring to FIGS. 1 to 3, an illuminated keyboard 1 in accordance with a first preferred embodiment of the invention is shown. The keyboard 1 is for laptop and comprises the following components from bottom to top as discussed in detail below.

A base plate 2 is waterproof. A spacer board 4 is made of aluminum or plastic and is provided on the base plate 2. The spacer board 4 comprises a plurality of units each corresponding to one of a plurality of keys 7 thereabove wherein the keys are arranged in a matrix layout. Each unit of the spacer board 4 includes two snapping grooves 41 as one group and two slide guide grooves 42 as the other group.

A film circuit board 5 is optically transmissive and is provided on the spacer board 4. The film circuit board 5 comprises a second circuitry 51 and a plurality of switch contacts 52 each is disposed below the key 7. The film circuit board 5 is capable of generating signals in response to a key press. A plurality of (four) holes 53 are provided each in a one to one relationship to the snapping groove 41 or the slide guide groove 42 so that the snapping groove 41 or the slide guide groove 42 may pass through the hole 53.

A rubber plate 6 is formed of optically transmissive plastic and is provided on the film circuit board 5. The rubber plate 6 comprises a plurality of resilient domes 61 each disposed below the key 7 and on the switch contact 52, the dome 61 having a top receptacle (not numbered) and a conductive bottom stem 611 disposed above the switch contact 52, and a plurality of holes 62 grouped as a plurality of groups each group formed as four corners around the dome 61, the holes 62 being aligned with the holes 53 and the snapping grooves 41 or the slide guide grooves 42 so that the snapping grooves 41 or the slide guide grooves 42 may pass through the holes 62. A downward movement of the stem 611 can contact the switch contact 52 to close a circuit as typically known in a key pressing operation. Thus, its detailed description is omitted herein for the sake of brevity.

An LED circuit board 3 is mounted on the rubber plate 6 and comprises a first circuitry 31 electrically connected to a power source (not shown), and a plurality of LEDs 32 electrically connected to the first circuitry 31. Thus, power can be supplied from the power source to the LEDs 32 for illumination via the first circuitry 31.

Each key 7 is illuminated by at least one LED 32. A cup shaped light concentration element (not shown) may be provided to contain the LED 32 therein. Moreover, a plurality of reflectors 35 are provided around each LED 32 (see FIG. 2). The provision of the light concentration elements and the reflectors 35 can increase the light concentration for improved efficiency.

The LED circuit board 3 further comprises a plurality of holes 39 each aligned with the hole 62, the hole 53, and the snapping grooves 41 or the slide guide grooves 42 so that the snapping grooves 41 or the slide guide grooves 42 may further pass through the holes 62. The LED circuit board 3 further comprises a plurality of circular openings 37 each aligned with the dome 61 so that the dome 61 pass through the opening 37.

The keys 7 are arranged on both the LED circuit board 3 and the rubber plate 6 based on a default arrangement. The key 7 comprises a key cap 71 and a scissor shaped structure 72. The key cap 7 includes on the bottom two pivot grooves 711, two slide guide grooves 712 with the pivot grooves 711 together arranged as four corners of a virtual quadrilateral, and a shaft 713 extending downward from the center through the scissor shaped structure 72 to dispose in the receptacle of the dome 61.

The scissor shaped structure 72 is disposed on the LED circuit board 3 and includes two first slide axles 721 at two corners of a first frame (not number), two second slide axles 722 at two corners of a second frame (not number) pivotal about the first frame, the second slide axles 722 being below the first slide axles 721, a first pivot shaft 723 at the opposite side of the second frame, a second pivot shaft 724 at the other side of the first frame parallel to and below the first pivot shaft 723, and a central circular hole 725. The first pivot shaft 723 is rotatably secured to the pivot grooves 711 and the first slide axles 721 are slidably secured to the slide guide grooves 712 respectively. The second slide axles 722 are slidably secured to the slide guide grooves 42 and the second pivot shaft 724 is rotatably secured to the snapping grooves 41 respectively. The shaft 713 extends downward through the hole 725 to dispose in the receptacle of the dome 61.

In use, a user may press the key 7 to push down the shaft 713 which in turn presses the dome 61 with the scissor shaped structure 72 being resiliently compressed. Thus, the stem 611 contacts the switch contact 52 to close. As a result, the depressed key 7 is activated. Further, light emitted by the LEDs 32 which are powered by an independent power source is substantially uniformly directed upward toward the keys 7 directly when the keyboard 1 is turned on. Hence, the keys 7 are lit uniformly.

Figure 4:
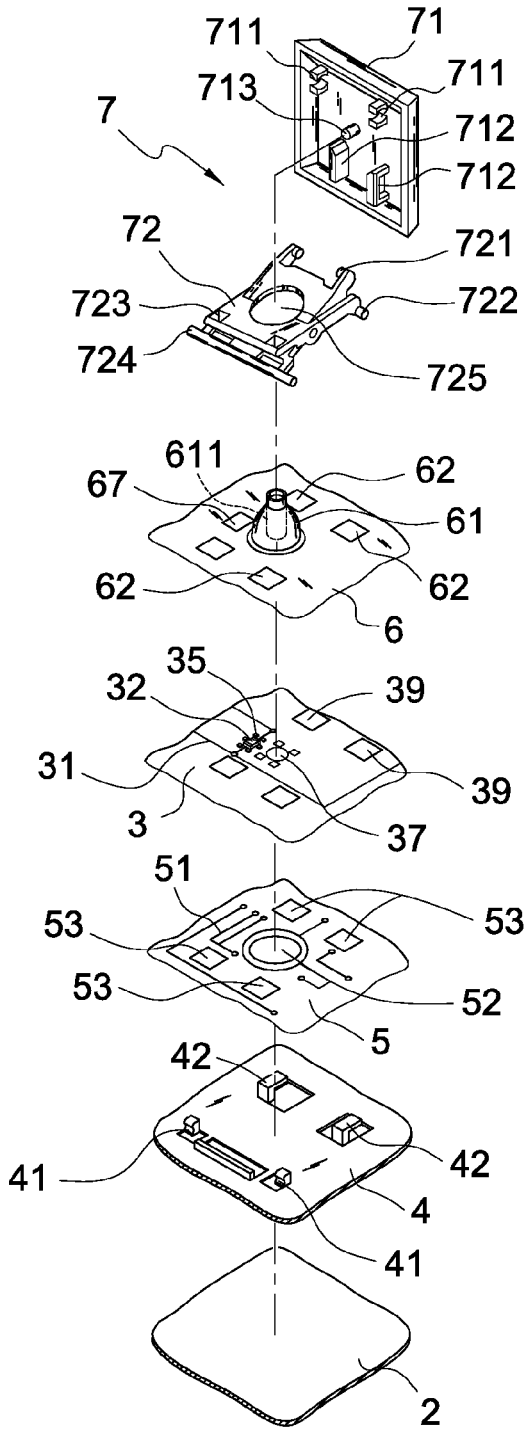
FIG. 4 is an exploded view showing a single key and associated components therebelow of an illuminated keyboard according to a second preferred embodiment of the invention.
Figure 5:
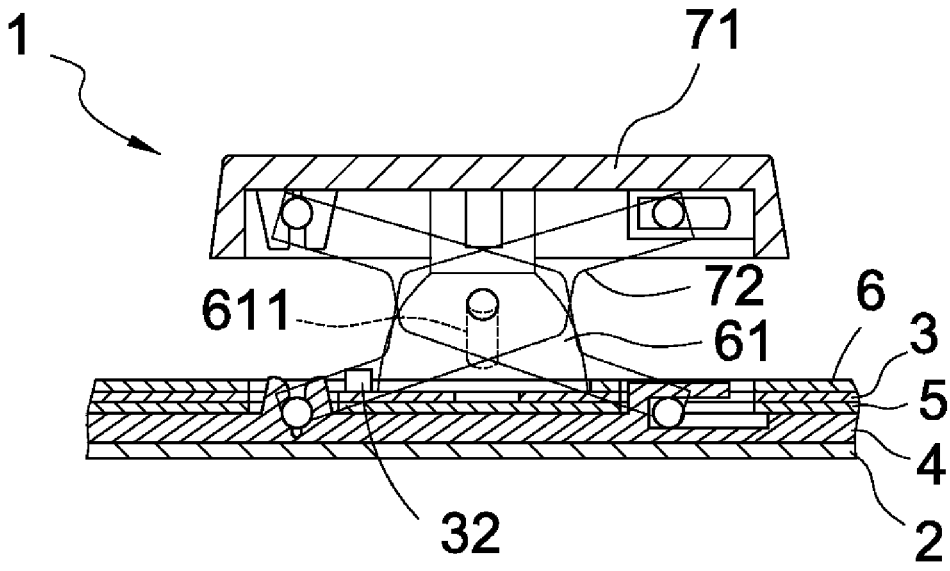
FIG. 5 is a longitudinal sectional view of the assembled key and its components in FIG. 4.

Referring to FIGS. 4 and 5, an illuminated keyboard 1 in accordance with a second preferred embodiment of the invention is shown. The keyboard 1 is for laptop and is constructed substantially the same as that of the first preferred embodiment except below. The rubber plate 6 is disposed on the LED circuit board 3 which is in turn disposed on the film circuit board 5. The rubber plate 6 further comprises a plurality of holes 67 each beside the dome 61. The LED 32 is disposed in the hole 67.

Figure 6:
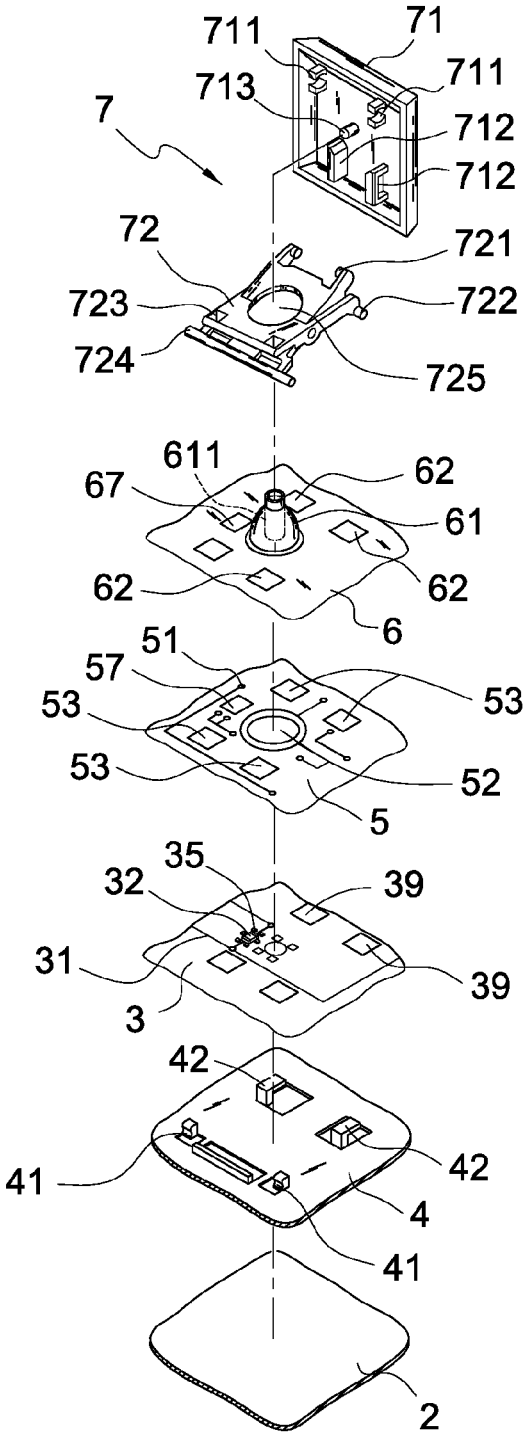
FIG. 6 is an exploded view showing a single key and associated components therebelow of an illuminated keyboard according to a third preferred embodiment of the invention.
Figure 7:
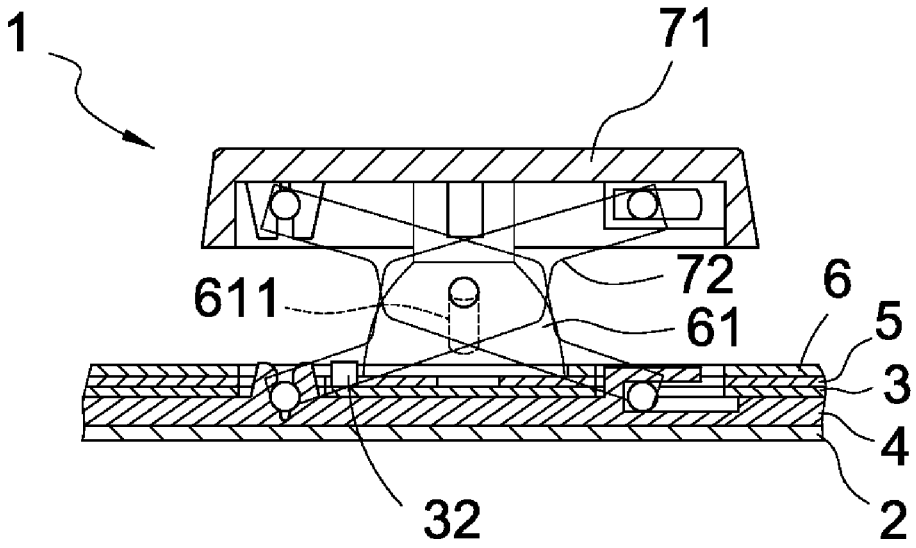
FIG. 7 is a longitudinal sectional view of the assembled key and its components in FIG. 6.

Referring to FIGS. 6 and 7, an illuminated keyboard 1 in accordance with a third preferred embodiment of the invention is shown. The keyboard 1 is for laptop and is constructed substantially the same as that of the first preferred embodiment except below. The rubber plate 6 is disposed on the film circuit board 5 which is in turn disposed on the LED circuit board 3. The rubber plate 6 further comprises a plurality of holes 67 each beside the dome 61. The film circuit board 5 further comprises a plurality of holes 57 each beside the switch contact 52. The LED 32 is disposed in the holes 57 and 67.

The illuminated keyboard 1 of the invention has the following advantages. It can be manufactured in low-profile. In the first preferred embodiment, the LED circuit board 3 is provided on the rubber plate 6 which is in turn disposed on the film circuit board 5. In the second preferred embodiment, the rubber plate 6 is provided on the LED circuit board 3 which is in turn disposed on the film circuit board 5. In the third preferred embodiment, the rubber plate 6 is provided on the film circuit board 5 which is in turn disposed on the LED circuit board 3. Hence, no contact between the LEDs 32 and both the film circuit board 5 and the rubber plate 6 is made. This eliminates the need of drilling the LED circuit board 3 which may adversely affect the yield of the product. Further, any malfunctioned LEDs 32 can be replaced individually without having to replace the LED circuit board 3, the film circuit board 5, and the rubber plate 6. This can greatly increase the production with decreased product defectiveness. Moreover, the LED circuit board 3 can be replaced individually when it is malfunctioned. This can be done without replacing the film circuit board 5. Hence, the production cost is greatly reduced and maintenance is made easier.

While the invention has been described in terms of preferred embodiments, those skilled in the art will recognize that the invention can be practiced with modifications within the spirit and scope of the appended claims.

What is claimed is:

1. An illuminated keyboard comprising:

a plurality of keys arranged in a matrix layout;

a base plate;

a spacer board disposed on the base plate, the spacer board comprising a plurality of units each corresponding to the key thereabove, each unit including two first groove connectors and two second groove connectors;

an optically transmissive film circuit board for generating signals in response to a pressing of the key, the film circuit board disposed on the spacer board and comprising a second circuitry, a plurality of switch contacts, and a plurality of first holes each being in a one to one relationship to the first or second groove connector so that the first or second groove connector is adapted to pass through the first hole;

a rubber plate formed of optically transmissive plastic and disposed on the film circuit board, the rubber plate comprising a plurality of resilient domes each disposed under the key, the dome having a recessed top for retaining the key, a conductive bottom stem disposed above the switch contact, and a plurality of second holes grouped as a plurality of groups, each group formed as four corners around the dome, the second holes being aligned with the first holes and the first groove connectors or the second groove connectors so that the first or second groove connectors are adapted to further pass through the second holes; and an LED circuit board disposed on the rubber plate and comprising a first circuitry and a plurality of LEDs electrically connected to the first circuitry to be powered therefrom, wherein the keys are disposed on the LED circuit board.

2. The illuminated keyboard of claim 1, wherein the key comprises a key cap including two pivot grooves on the bottom, two slide guide grooves on the bottom opposite the pivot grooves, and a shaft extending downward from the bottom to retain in the dome; and a pivotal scissor shaped structure disposed on the rubber plate and comprising two upper first slide axles at two corners, two lower second slide axles at another two corners the same side as the first slide axles, an upper first pivot shaft opposing the first slide axles, a lower second pivot shaft opposing the second slide axles and at the same side as the first pivot shaft, and a central hole.

3. The illuminated keyboard of claim 2, wherein the first pivot shaft is rotatably secured to the pivot grooves and the first slide axles are slidably secured to the slide guide grooves respectively, the second slide axles are slidably secured to the second groove connectors and the second pivot shaft is rotatably secured to the first groove connectors respectively, the stem passes the central hole, and the shaft is aligned with and disposed above the stem by a predetermined distance.

4. The illuminated keyboard of claim 2, wherein in response to pressing the key, the shaft is pushed down to press the dome with the scissor shaped structure being resiliently compressed, thereby causing the stem to electrically connect to the switch contact.

5. The illuminated keyboard of claim 1, further comprising a plurality of cup shaped light concentration elements each for containing the LED, and a plurality of reflectors each being adjacent to the LED.

6. An illuminated keyboard comprising:

a plurality of keys arranged in a matrix layout;

a base plate;

a spacer board disposed on the base plate, the spacer board comprising a plurality of units each corresponding to the key thereabove, each unit including two first groove connectors and two second groove connectors;

an optically transmissive film circuit board for generating signals in response to a pressing of the key, the film circuit board disposed on the spacer board and comprising a second circuitry, a plurality of switch contacts, and a plurality of first holes each being in a one to one relationship to the first or second groove connector so that the first or second groove connector is adapted to pass through the first hole;

an LED circuit board disposed on the film circuit board and comprising a first circuitry and a plurality of LEDs electrically connected to the first circuitry to be powered therefrom; and a rubber plate formed of optically transmissive plastic and disposed on the LED circuit board, the rubber plate comprising a plurality of resilient domes each disposed under the key, the dome having a recessed top for retaining the key, a conductive bottom stem disposed above the switch contact, a plurality of second holes each adjacent to the dome, and a plurality of third holes grouped as a plurality of groups, each group formed as four corners around the dome, the third holes being aligned with the first holes and the first groove connectors or the second groove connectors so that the first or second groove connectors are adapted to further pass through the third holes, wherein the keys are disposed on the rubber plate and the LED is disposed in the second hole.

7. The illuminated keyboard of claim 6, wherein the key comprises a key cap including two pivot grooves on the bottom, two slide guide grooves on the bottom opposite the pivot grooves, and a shaft extending downward from the bottom to retain in the dome; and a pivotal scissor shaped structure disposed on the rubber plate and comprising two upper first slide axles at two corners, two lower second slide axles at another two corners the same side as the first slide axles, an upper first pivot shaft opposing the first slide axles, a lower second pivot shaft opposing the second slide axles and at the same side as the first pivot shaft, and a central hole.

8. The illuminated keyboard of claim 7, wherein the first pivot shaft is rotatably secured to the pivot grooves and the first slide axles are slidably secured to the slide guide grooves respectively, the second slide axles are slidably secured to the second groove connectors and the second pivot shaft is rotatably secured to the first groove connectors respectively, the stem passes the central hole, and the shaft is aligned with and disposed above the stem by a predetermined distance.

9. The illuminated keyboard of claim 7, wherein in response to pressing the key, the shaft is pushed down to press the dome with the scissor shaped structure being resiliently compressed, thereby causing the stem to electrically connect to the switch contact.

10. The illuminated keyboard of claim 6, further comprising a plurality of cup shaped light concentration elements each for containing the LED, and a plurality of reflectors each being adjacent to the LED.

11. An illuminated keyboard comprising:

a plurality of keys arranged in a matrix layout;

a base plate;

a spacer board disposed on the base plate, the spacer board comprising a plurality of units each corresponding to the key thereabove, each unit including two first groove connectors and two second groove connectors;

an optically transmissive film circuit board for generating signals in response to a pressing of the key, the film circuit board disposed on the spacer board and comprising a second circuitry, a plurality of switch contacts, a plurality of first holes each adjacent to the switch contact, and a plurality of second holes each being in a one to one relationship to the first or second groove connector so that the first or second groove connector is adapted to pass through the second hole;

an LED circuit board disposed on the film circuit board and comprising a first circuitry and a plurality of LEDs electrically connected to the first circuitry to be powered therefrom; and a rubber plate formed of optically transmissive plastic and disposed on the LED circuit board, the rubber plate comprising a plurality of resilient domes each disposed under the key, the dome having a recessed top for retaining the key, a conductive bottom stem disposed above the switch contact, a plurality of third holes each adjacent to the dome, and a plurality of fourth holes grouped as a plurality of groups, each group formed as four corners around the dome, the fourth holes being aligned with the second holes and the first groove connectors or the second groove connectors so that the first or second groove connectors are adapted to further pass through the fourth holes, wherein the keys are disposed on the rubber plate and the LED is disposed in the first and third holes.

12. The illuminated keyboard of claim 11, wherein the key comprises a key cap including two pivot grooves on the bottom, two slide guide grooves on the bottom opposite the pivot grooves, and a shaft extending downward from the bottom to retain in the dome; and a pivotal scissor shaped structure disposed on the rubber plate and comprising two upper first slide axles at two corners, two lower second slide axles at another two corners the same side as the first slide axles, an upper first pivot shaft opposing the first slide axles, a lower second pivot shaft opposing the second slide axles and at the same side as the first pivot shaft, and a central hole.

13. The illuminated keyboard of claim 12, wherein the first pivot shaft is rotatably secured to the pivot grooves and the first slide axles are slidably secured to the slide guide grooves respectively, the second slide axles are slidably secured to the second groove connectors and the second pivot shaft is rotatably secured to the first groove connectors respectively, the stem passes the central hole, and the shaft is aligned with and disposed above the stem by a predetermined distance.

14. The illuminated keyboard of claim 12, wherein in response to pressing the key, the shaft is pushed down to press the dome with the scissor shaped structure being resiliently compressed, thereby causing the stem to electrically connect to the switch contact.

15. The illuminated keyboard of claim 11, further comprising a plurality of cup shaped light concentration elements each for containing the LED, and a plurality of reflectors each being adjacent to the LED.

* * * * *